US007082793B2

(12) United States Patent
Reinwald et al.

(10) Patent No.: US 7,082,793 B2
(45) Date of Patent: Aug. 1, 2006

(54) DRUM-TYPE WASHING MACHINE HAVING A LAUNDRY DRUM WHICH CAN BE LOADED FROM THE FRONT

(75) Inventors: Eckehard Reinwald, Berlin (DE); Ingo Schulze, Zepernick (DE); Stephan Sommer, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/914,912

(22) Filed: Aug. 9, 2004

(65) Prior Publication Data

US 2005/0044899 A1 Mar. 3, 2005

Related U.S. Application Data

(63) Continuation of application No. PCT/EP03/00418, filed on Jan. 16, 2003.

(30) Foreign Application Priority Data

Feb. 8, 2002 (DE) ..... 102 05 306

(51) Int. Cl.
*D06F 37/26* (2006.01)

(52) U.S. Cl. ..... 68/19.2; 68/24; 68/58; 68/140

(58) Field of Classification Search ..... 68/19, 68/19.1, 19.2, 20, 24, 58, 140
See application file for complete search history.

(56) References Cited

U.S. PATENT DOCUMENTS 2,555,821 A * 6/1951 Smith ..... 34/76
2,556,303 A * 6/1951 Traube ..... 68/19.2
2,562,533 A * 7/1951 Dunlap ..... 68/21
2,587,080 A * 2/1952 Abresch ..... 137/102
2,875,602 A * 3/1959 Galinski ..... 68/19.2
2,921,384 A * 1/1960 Smith ..... 34/75
3,040,440 A * 6/1962 Mellinger et al. ..... 34/75
3,306,083 A * 2/1967 Lornitzo ..... 68/12.08
3,426,446 A * 2/1969 Lotzsch ..... 34/77
3,626,728 A * 12/1971 Traube et al. ..... 68/18 F
3,841,117 A * 10/1974 Crivilles ..... 68/20
4,024,735 A * 5/1977 Marchiselli ..... 68/16
4,305,211 A * 12/1981 Peterson ..... 34/92
4,811,495 A * 3/1989 Huang et al. ..... 34/131
5,768,730 A * 6/1998 Matsumoto et al. ..... 8/159
5,816,074 A 10/1998 Kim
6,082,022 A * 7/2000 St. Louis ..... 34/602
6,334,341 B1 * 1/2002 Hellhake et al. ..... 68/124

FOREIGN PATENT DOCUMENTS

DE 1 259 283 1/1968

(Continued)

*Primary Examiner*—Frankie L. Stinson

(74) *Attorney, Agent, or Firm*—John T. Winburn; Russell W. Warnock; Craig J. Loest

(57) ABSTRACT

A cylinder washing machine includes a front-loading cylinder, the shell of which is provided with holes and is surrounded by a container. The cylinder washing machine includes a cycle for spin-drying the laundry contained in the cylinder. To prevent water that has already been spun out of the laundry from being transported back to the interior space of the cylinder during spin-drying, precautions are taken to prevent substantially any air from flowing from the container through the interior space of the cylinder and back to the container during spin-drying.

11 Claims, 3 Drawing Sheets

FOREIGN PATENT DOCUMENTS

| | | | | |
|---|---|---|---|---|
| DE | 1 460 840 | | | 2/1969 |
| DE | 1 460 812 | | | 3/1969 |
| DE | 25 55 409 | | * | 6/1976 |
| DE | 29 23 635 | | * | 10/1980 |
| DE | 37 38 388 | A1 | | 5/1989 |
| DE | 41 18 395 | | * | 12/1992 |
| DE | 197 12 086 | A1 | | 9/1998 |
| EP | 0 390 343 | A2 | | 10/1990 |
| EP | 0 810 319 | B1 | | 12/1997 |
| EP | 1 118 704 | A1 | | 7/2001 |
| GB | 1023278 | | | 3/1966 |
| GB | 1 568 045 | | | 5/1980 |
| GB | 1 461 073 | | * | 1/1997 |
| JP | 59-85697 | | * | 5/1984 |
| JP | 60-90599 | | * | 5/1985 |
| JP | 1-268594 | | * | 10/1989 |
| JP | 3-162897 | | * | 7/1991 |
| JP | 3-234298 | | * | 10/1991 |
| JP | 4-35687 | | * | 2/1992 |
| JP | 8-243290 | | * | 9/1996 |
| WO | 02/10498 | A1 | | 2/2002 |

* cited by examiner

DRUM-TYPE WASHING MACHINE HAVING A LAUNDRY DRUM WHICH CAN BE LOADED FROM THE FRONT

CROSS-REFERENCE TO RELATED APPLICATION

This application is a continuation, under 35 U.S.C. § 120, of copending international application No. PCT/EP03/00418, filed Jan. 16, 2003, which designated the United States; this application also claims the priority, under 35 U.S.C. § 119, of German patent application No. 102 05 306.5, filed Feb. 8, 2002; the prior applications are herewith incorporated by reference in their entirety.

BACKGROUND OF THE INVENTION

Field of the Invention

The invention relates to a drum-type washing machine having a laundry drum that can be loaded from the end side, of which the casing is perforated and which is enclosed by a tub, within which it is mounted in an at least more or less horizontally floating manner at its rear wall, and having an operating section for spin drying the laundry located in the drum.

Such a washing machine is described in European Patent EP 0 810 319 B1, corresponding to U.S. Pat. No. 5,816,074 to Kim. The laundry drum, which is mounted in a floating manner, of the Kim washing machine has a drum casing with uniformly distributed flow holes that, during spinning, are intended to discharge, into the tub, the moisture driven out of the laundry. It is common practice to distribute flow holes, in accordance with the Kim washing machine, uniformly over the drum casing, which is also verified, inter alia, by German Patent DE 1 259 283 B1, German Published, Non-Prosecuted Patent Application DE 1 460 812 A1, and German Published, Non-Prosecuted Patent Application DE 1 460 840 A1, which otherwise disclose a wide variety of different configurations and materials for a laundry drum that can be loaded from the end side.

Such so-called front-loading washing machines usually have a rubber sleeve as the watertight connection between the tub, which is mounted for vibration, and the fixed housing opening. The rubber sleeve from German Published, Non-Prosecuted Patent Application DE 37 38 388 A1 may be mentioned here as an example of such a rubber sleeve, this sleeve also having outflow holes to the tub in its lowermost portion so that residual water cannot remain in the folds of the sleeve. Such residual water is a problem, in particular, during spinning; that is to say, when the tub assembly, which is suspended F or vibration, executes pronounced vibratory movements and the sleeve tends to oscillate severely in the process. Residual water is, then, slung up out of the sleeve and passes back to the laundry from which it has just been spun out. This operation impairs the spinning result.

Those skilled in the art, then, thought that this measure had solved the problems outlined. Surprisingly, however, this rewetting effect is still present despite the outflow holes in the sleeve. The question, then arises: where is the water that is rewetting the laundry coming from?

SUMMARY OF THE INVENTION

It is accordingly an object of the invention to provide a drum-type washing machine having a laundry drum that can be loaded from the front that overcomes the hereinafore-mentioned disadvantages of the heretofore-known devices of this general type and that take measures that, if not doing away with this rewetting effect altogether, at least reduce the effect and, thus, also promise more easily reproducible residual-moisture values for the same types of spinning process.

With the foregoing and other objects in view, there is provided, in accordance with the invention, a drum-type washing machine, including a housing, a tub disposed in the housing and having an end side at which laundry is loaded, and a laundry drum disposed in the tub, the laundry drum having a drum casing defining an interior and having an operating section for spin-drying laundry located in the laundry drum, a rear wall at which the laundry drum is mounted in the tub in a substantially horizontally floating manner, and a perforated structure that, during spin-drying of the laundry, substantially prevents air from flowing from the tub through the interior of the laundry drum and back to the tub.

According to the present invention, measures are taken so that, during the spin-drying, substantially no air can flow from the tub through the interior of the drum and back to the tub.

This is because it has been found that, during the spinning, predominantly the rear flow holes of the drum casing are insufficiently covered with laundry so that the flow holes are also concealed there. This effect is aided by one-sided axial mounting in the case of a front-loading washing machine with at least more or less horizontal drum axis and the associated relatively large deflections of the rotating laundry drum in the front region. This is because the ring of laundry positioned against the inside of the drum casing is, thus, transported axially forward to a pronounced extent.

The large number of flow holes that are, thus, exposed in the rear region of the drum give rise to the formation of an air stream in the laundry drum, in particular, at spinning speeds of higher than 1400 rpm, because the drum can, then, act, as it were, as a radial fan wheel. This is because the drum, then, draws in air through the central loading opening and forces it, through the exposed flow holes, into the interspace between the drum and tub, from where it passes back again, through the narrow gap between the front tub opening and loading opening of the drum, to the central opening on the sleeve. This effect is probably even assisted by water that is entrained from the lowest portion of the sleeve by the air stream that is additionally sucked through the outflow holes in the sleeve. The water entrained by the air stream over these paths is guided onto the laundry again from the loading opening.

This effect is present even without any residual water in the bottom region of the sleeve because the water that rewets the laundry comes from the tub and is entrained from there by the air stream.

The above-described disadvantages, then, can be prevented by the present invention. On one hand, this is because it is possible to achieve smaller residual-moisture values than without the measures according to the invention and, on the other hand, it is possible to reproduce these values for comparable spinning processes. If, during spinning, the sleeve executes pronounced oscillating movements, water droplets may well spray up but, on account of the air stream being more or less avoided, they no longer pass into the drum interior so that there is no longer any risk of any rewetting effect.

In accordance with another feature of the invention, a flow resistor is disposed in the path of a potential air stream out of the tub through the interior of the drum and back to the tub. Such a flow resistor would prevent an above-described air stream from forming, or would reduce it at least to the extent where the residual stream no longer has efficient energy for entraining spun-out water from the tub.

A possible configuration of such a flow resistor would be constituted by a barrier that is disposed in the annular gap between the loading opening of the drum and the front opening of the tub In accordance with a further feature of the invention, on an annular section that adjoins the rear wall of the drum, the drum casing has an at least smaller specific proportion of perforated surface area than on the annular section that is disposed closer to the loading opening.

This is because it has been observed that, at the beginning of the spinning section, the laundry positions itself on the drum casing predominantly in the front region of the laundry drum and leaves the annular section in the vicinity of the rear wall free. If, however, there are, then, likewise flow holes present in the rear section that are not covered by the laundry, the air that is taken in through the loading opening during high-speed spinning can be forced through these free flow holes into the enclosing tub and annular flow arises. If, in contrast, this annular section does not have any flow holes, or has only relatively small or relatively few flow holes, then the flow resistance is too great for this potential air flow and any significant flow does not arise in the first place.

Such a configuration of the invention is particularly advantageous because the reduced perforating surface area in the rear region of the drum casing gives the laundry drum a higher level of mechanical strength. Moreover, this measure obviously avoids additional measures for increasing the flow resistance.

Dimensions of the annular section that have proven to be particularly advantageous are ones in which the width of the annular section measures approximately a tenth of the width of the part of the drum casing that is perforated over the entire surface area. It is quite sufficient, here, if the specific overall perforated surface area in this annular section is approximately 50% of the perforated surface area of that in the front region of the laundry drum.

A fair number of laundry drums are also perforated on their rear wall, to ensure a more intensive exchange of the washing liquid with the laundry. To apply and develop the invention, in such a washing machine, the rear wall of the drum has an annular-disk section that is adjacent to the drum casing and has a smaller specific proportion of perforated surface area than the disk section that is disposed directly opposite the loading opening.

In accordance with an added feature of the invention, the surface area of the disk section of the rear wall corresponds at least more or less to the surface area of the loading opening. This is because this part of the perforated rear wall has the same pressure conditions as the equiaxial loading opening.

The reduction in the specific proportion of perforated surface area can be achieved in that, in the first row of holes disposed on a circumference line outside the part that is perforated over the entire surface area, every sixth hole (in the case of a total quantity of 30 holes per row) is left out. In each row of holes that is further away, it is, then, possible to leave out in each case one further hole or alternately one or two holes or progressively one, two, three, etc. holes from a basic quantity of six, seven, eight, nine or ten holes per interval (depending on how the total quantity of holes are divided up in each row).

With the objects of the invention in view, in a drum-type washing machine having a tub loaded from an end side, there is also provided a laundry drum including a perforated laundry casing enclosed by the tub and defining an interior, the laundry casing having an operating section for spin-drying laundry located in the casing, a rear wall at which the casing is mounted in the tub in a substantially horizontally floating manner, and a perforated structure that, during spin-drying of the laundry, substantially prevents air from flowing from the tub through the interior and back to the tub.

With the objects of the invention in view, there is also provided a laundry drum for a drum-type washing machine having a tub loaded from an end side, the laundry drum including a perforated laundry casing to be enclosed by the tub and defining an interior, the laundry casing having an operating section for spin-drying laundry located in the casing, a rear wall at which the casing is mounted in the tub in a substantially horizontally floating manner, and a perforated structure that, during spin-drying of the laundry, substantially prevents air from flowing from the tub through the interior and back to the tub.

Other features that are considered as characteristic for the invention are set forth in the appended claims.

Although the invention is illustrated and described herein as embodied in a drum-type washing machine having a laundry drum that can be loaded from the front, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
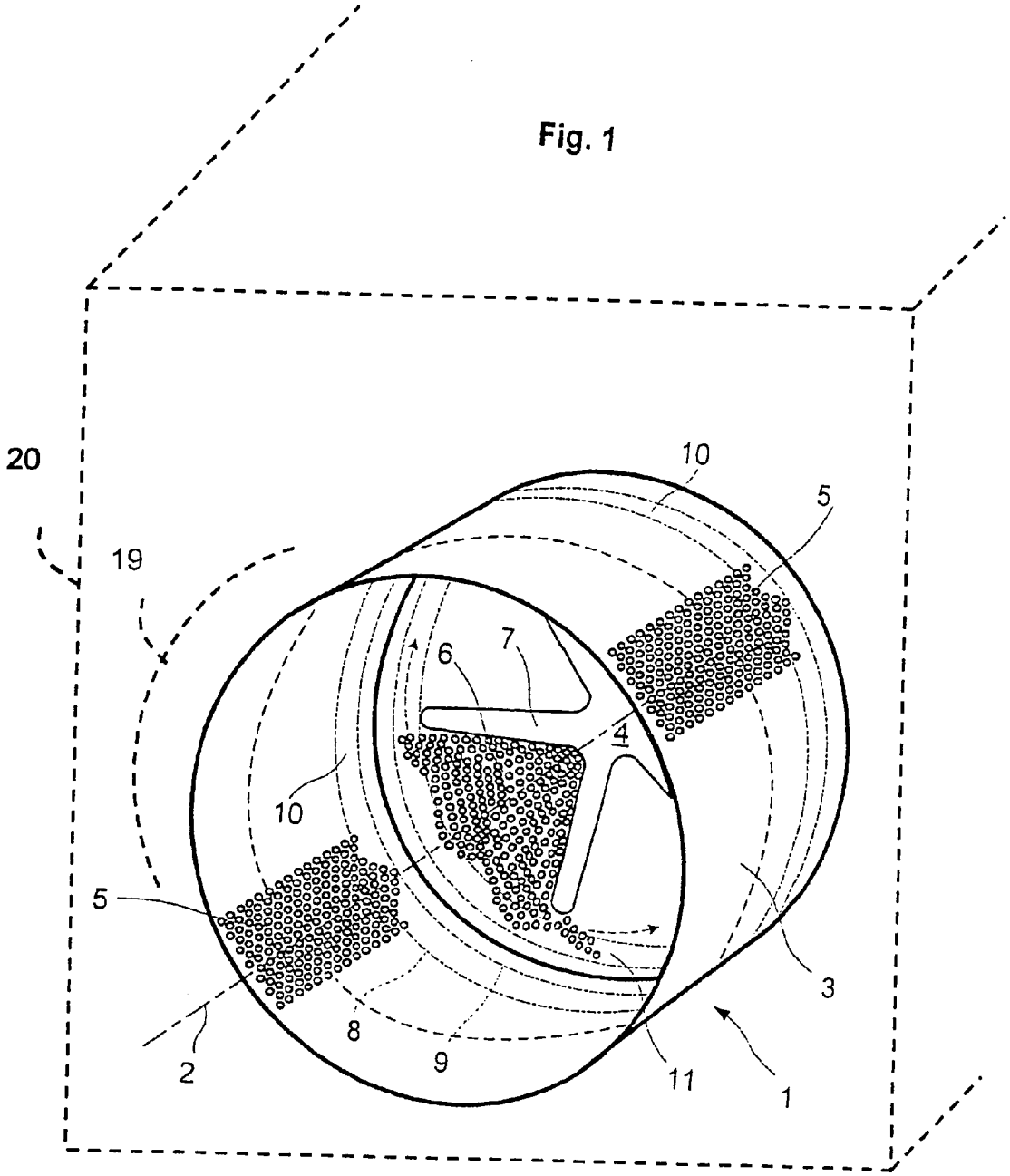
FIG. 1 is a perspective view of a laundry drum according to the invention having an end base removed to give a better view into the interior.

Referring now to the figures of the drawings in detail and first, particularly to FIG. 1 thereof, there is shown a laundry drum 1 mounted in a tub 19 of a laundry machine 20 a rotatable manner about an, in this case, horizontally disposed axis 2 and includes a drum casing 3, a rear wall 4, and a non-illustrated end base that has been removed to give a better view into the interior of the drum.

The casing 3 and the rear wall 4 are provided with respective flow holes 5 and 6 of any desired formation, which are used for exchanging the washing liquid on a constant basis during the washing phase. The dashed arcuate lines indicate that the perforated areas extend in the relevant direction. During the spinning section, most of the rinsing liquid that is still present in the laundry following the rinsing process is spun out of the drum casing through the flow holes 5 of the drum casing 3. The rear wall 4 is provided, in a known manner, for stabilizing purposes, with a star-shaped embossed formation 7.

It can already be seen in FIG. 1 that, on the annular section 10 that adjoins the rear wall 4 of the drum 1 and is indicated by the two boundary lines 8 and 9, the specific proportion of perforated surface area is considerably reduced in relation to the rest of the perforated surface area. Similarly, the specific proportion of perforated surface area in an annular-disk section 11 of the rear wall 4 of the drum, this annular-disk section 11 being adjacent to the drum casing 3, is also reduced in relation to the rest of the perforated surface area of the rear wall 4. It is only that surface area of a disk section of the rear wall 4 that corresponds approximately to the surface area of the loading opening located opposite that is perforated over the entire surface area—with the exception of the stiffening embossed formation.

FIGS. 2 to 9 show different patterns of holes in the annular sections 10 with differently sized specific proportions of perforated surface area. The sections 12 that are perforated over the entire surface area are bordered by the peripheral rows 13 and 14 of holes; between these peripheral rows, of course, rows of holes are disposed down to the lowermost continuous row of holes 14, in the same way as on the top peripheral 13.

Figure 2:
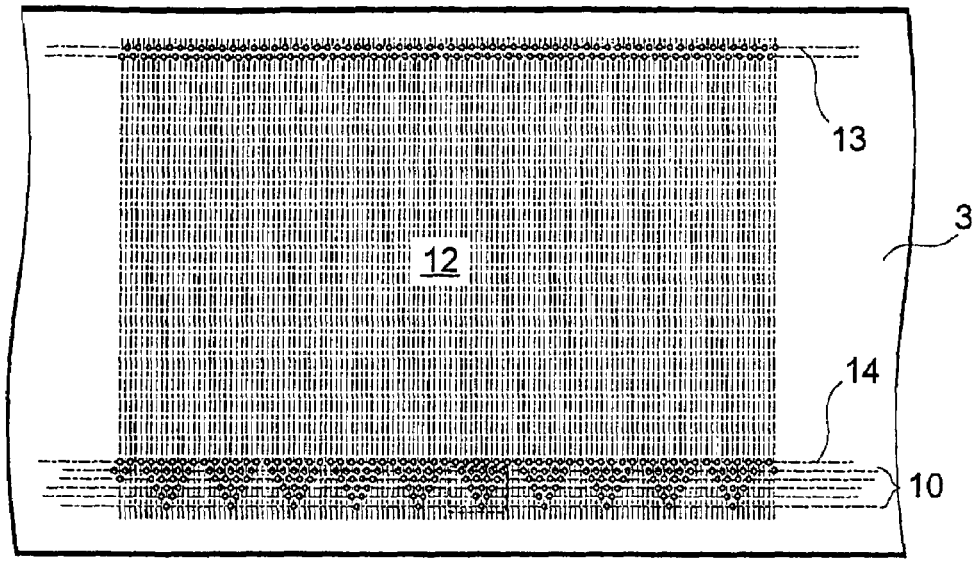
FIG. 2 is a fragmentary, projected view of a portion of a drum casing according to the invention with one form of reducing the specific proportion of perforated surface area in the annular region in the vicinity of the rear wall of the drum.
Figure 3:
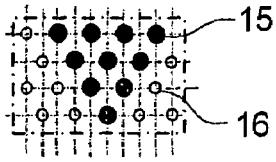
FIG. 3 is a fragmentary, enlarged projected view of a triangular region of flow holes in the annular region of the drum casing of FIG. 2.

The proportions of perforated surface area in the annular section 10 in FIGS. 2 and 3 are, thus, reduced to 50% of the proportion of perforated surface area in the section 12. This is achieved in that equally sized triangular regions of perforations and perforation-free surface areas alternate along a lateral line. If, then, no laundry ends up located over the annular section 10 during the spinning section, then the reduced proportion of perforated surface area, nevertheless, renders the flow resistance large enough at least to obstruct the occurrence of a closed flow described above.

Twenty perforation locations are present in the enlarged illustration (FIG. 3) of a triangular region in accordance with the surround in FIG. 2, ten of these perforation locations being occupied by gray-backed flow holes 15. The perforation locations that are not occupied are indicated by smaller white circles 16. Accordingly, this gives a proportion of perforated surface area of 50%.

It is possible to achieve a proportion of perforated surface area of less than 50% if the annular section 10 is configured according to FIGS. 4 to 9.

Figure 4:
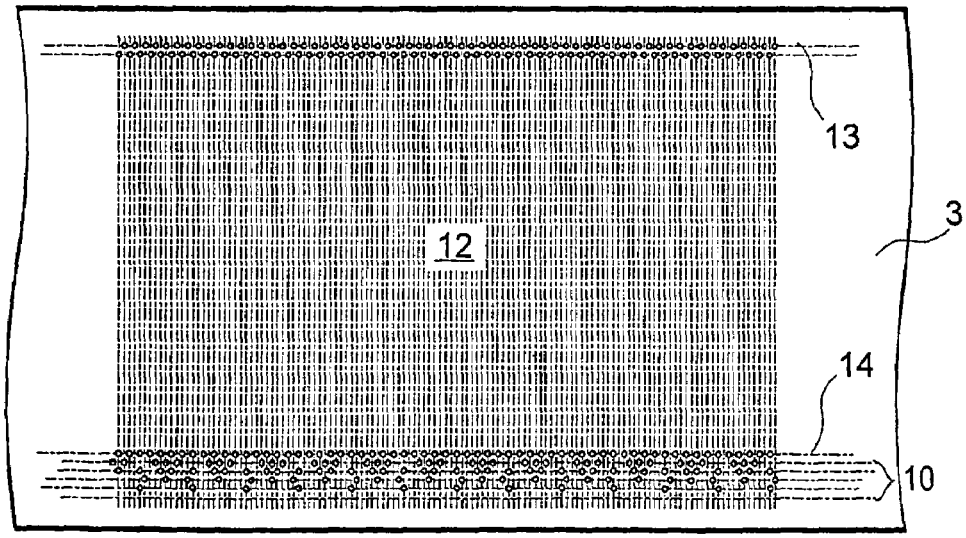
FIG. 4 is a fragmentary, projected view of a portion of the drum casing of FIG. 2 with a smaller specific proportion of perforated surface area than in the casing of FIG. 2.
Figure 5:
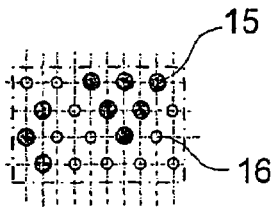
FIG. 5 is a fragmentary, enlarged projected view of a triangular region of flow holes in the annular region of the drum casing of FIG. 4.

In FIGS. 4 and 5, of twenty possible locations in a triangular region, just nine are occupied by holes 15. This makes it possible to achieve a proportion of perforated surface area of just 45% in relation to the full surface area being occupied by perforations. The flow resistance is correspondingly higher.

Figure 6:
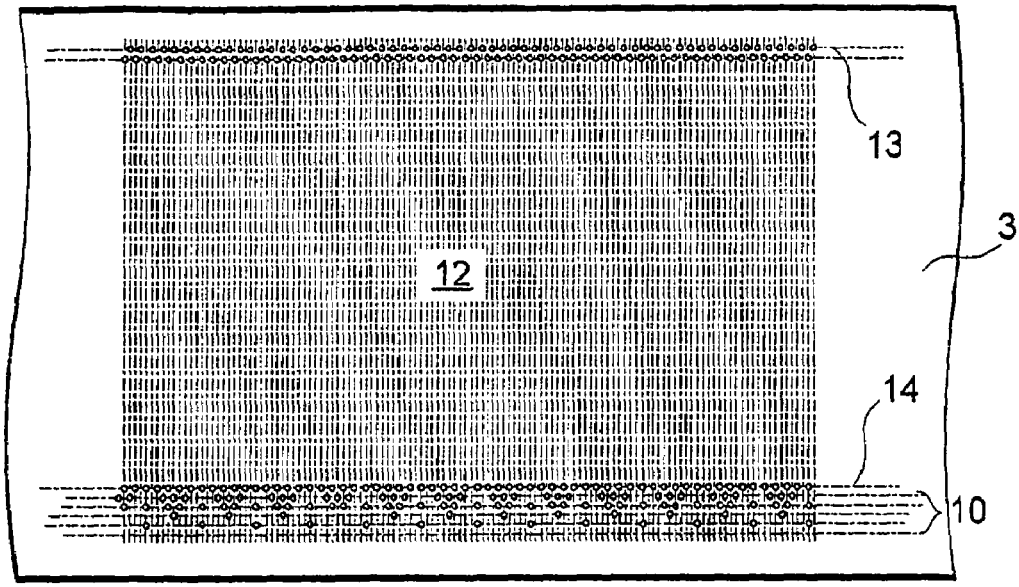
FIG. 6 is a fragmentary, projected view of a portion of the drum casing of FIG. 2 with a smaller specific proportion of perforated surface area than the drum casing of FIG. 4.
Figure 7:
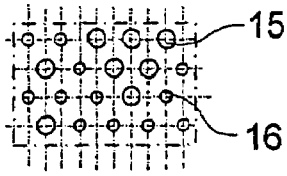
FIG. 7 is a fragmentary, enlarged projected view of a triangular region of flow holes in the annular region of the drum casing according of FIG. 6.

In the case of the exemplary embodiment in FIGS. 6 and 7, a proportion of perforated surface area of just 40% is present because, in a triangular region, just eight of twenty perforation locations are occupied by holes 15.

Figure 8:
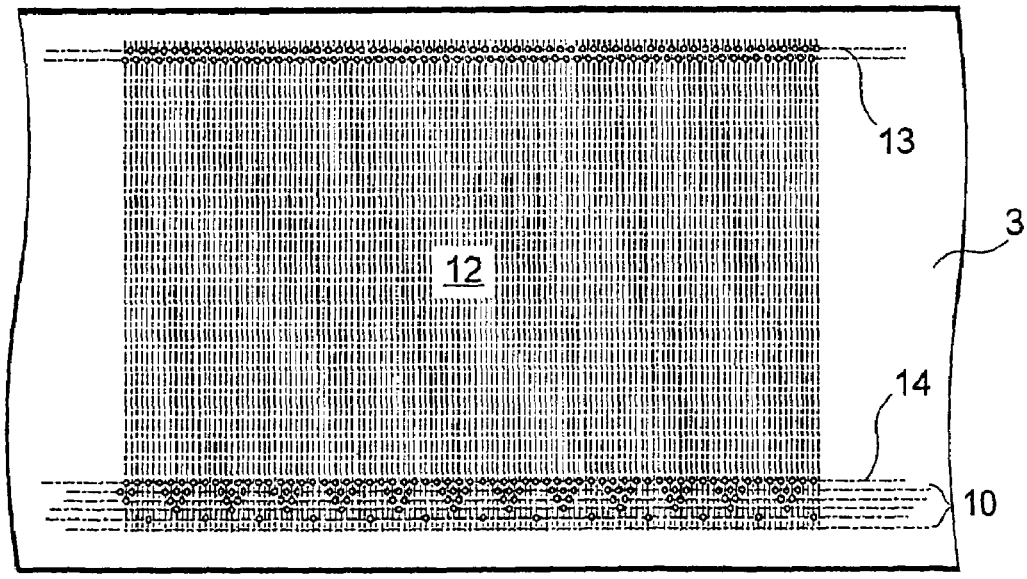
FIG. 8 is a fragmentary, projected view of a portion of the drum casing of FIG. 2 with a smaller specific proportion of perforated surface area than the drum casing in FIG. 6.
Figure 9:
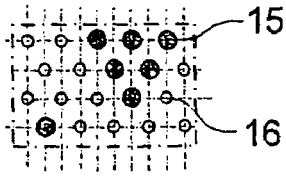
FIG. 9 is a fragmentary, enlarged projected view of a triangular region of flow holes in the annular region of the drum casing of FIG. 8.

In the exemplary embodiment of FIGS. 8 and 9, just seven of twenty perforation locations are occupied by gray-backed holes 15, this giving a proportion of perforated surface area of 35%.

Other more or less small proportions of perforated surface area may also be achieved using corresponding variations of triangular regions in the annular section 10, so that various different flow resistances can be set very precisely using other values for proportions of perforated surface area.

Instead of reducing the proportions of perforated surface area by decreasing the number of holes per unit of surface area, or in addition to the same, it is also possible for the flow holes in the rear region to have a smaller diameter than in the front region, which is reliably covered by the laundry. The flow resistance would, likewise, be increased in this way.

A continuous or discontinuous reduction in the specific proportions of perforated surface area from the front to the rear would, likewise, lie within the scope of the invention and will aid the desired effect, in which case the delimitation of the annular section would just be unclearly defined.

Finally, it is even possible for the annular section to be provided with no holes at all so that the flow resistance tends toward $\infty$.

In accordance with the exemplary embodiments shown here, it is also possible for the flow resistance of an annular-disk section 11 of the rear wall 4 of a laundry drum 1 to be adjusted, provided the rear wall is, in fact, perforated.

We claim:

1. A drum-type washing machine, comprising:

a housing;

a tub disposed in said housing and having an end side at which laundry is loaded; and a laundry drum disposed in said tub, said laundry drum having:

a drum casing defining an interior and an interspace between said drum and said tub, and having:

an operating section for spin-drying laundry located in said laundry drum:

a rear wall at which said laundry drum is mounted in said tub in a substantially horizontally floating manner;

a perforated structure that, during spin-drying of the laundry, substantially prevents air from flowing from said interspace through said interior of said laundry drum and back to said interspace; and wherein said perforated structure has a flow resistor disposed in a path of a potential air stream out of the tub through said interior of said drum and back to the tub.

2. The drum-type washing machine according to claim 1, wherein:

the tub has a front opening;

said drum has a loading opening;

said operating section has an annular gap disposed between said loading opening of said drum and the front opening of the tub; and said flow resistor is a barrier disposed in said annular gap.

3. A drum-type washing machine, comprising:
a housing;
a tub disposed in said housing and having an end side at which laundry is loaded; and
a laundry drum disposed in said tub, said laundry drum having:
a drum casing defining an interior and an interspace between said drum and said tub, and having:
an operating section for spin-drying laundry located in said laundry drum:
a rear wall at which said laundry drum is mounted in said tub in a substantially horizontally floating manner;
a perforated structure that, during spin-drying of the laundry, substantially prevents air from flowing from said interspace through said interior of said laundry drum and back to said interspace;
said drum casing defines a loading opening;
said operating section has:
a first annular section adjoining said rear wall; and
a second annular section disposed closer to said loading opening; and
said first annular section has an at least smaller proportion of perforated surface area than said second annular section.

4. The drum-type washing machine according to claim 3, wherein:
said operating section has a perforation section with a surface area having perforations over an entirety thereof;
said perforation section has a width; and
said first annular section has a width equal to approximately one-tenth of said width of said perforation section.

5. A drum-type washing machine, comprising:
a housing;
a tub disposed in said housing and having an end side at which laundry is loaded; and
a laundry drum disposed in said tub, said laundry drum having:
a drum casing defining an interior and an interspace between said drum and said tub, and having:
an operating section for spin-drying laundry located in said laundry drum:
a rear wall at which said laundry drum is mounted in said tub in a substantially horizontally floating manner;
a perforated structure that, during spin-drying of the laundry, substantially prevents air from flowing from said interspace through said interior of said laundry drum and back to said interspace;
said drum casing defines a loading opening;
said rear wall has:
a disk section disposed directly opposite said loading opening; and
an annular-disk section adjacent to said operating section and having a smaller specific proportion of perforated surface area than said disk section.

6. The drum-type washing machine according to claim 5, wherein:
said loading opening has a surface area; and
said annular-disk section of said rear wall has a surface area corresponding approximately to said surface area of said loading opening.

7. A laundry drum for a drum-type washing machine having a tub loaded from an end side, the laundry drum comprising:
a perforated drum casing to be enclosed by the tub and defining an interior and an interspace between said drum and said tub, said drum casing having:
an operating section for spin-drying laundry located in said drum casing;
a rear wall at which said drum casing is mounted in the tub in a substantially horizontally floating manner;
a perforated structure that, during spin-drying of the laundry, substantially prevents air from flowing from the interspace through said interior and back to the interspace; and
wherein the perforated drum casing includes a main section and an annular section being disposed between the main section and the rear wall, the proportion of perforated surface area of the annular section being less than the proportion of perforated surface area of the main section.

8. The laundry drum according to claim 7, wherein the proportion of perforated surface area of the annular section is less than about 50% of the proportion of perforated surface area of the main section.

9. The laundry drum according to claim 7, wherein the proportion of perforated surface area of the annular section is less than about 45% of the proportion of perforated surface area of the main section.

10. The laundry drum according to claim 7, wherein the proportion of perforated surface area of the annular section is less than about 40% of the proportion of perforated surface area of the main section.

11. The laundry drum according to claim 7, wherein the proportion of perforated surface area of the annular section is less than about 35% of the proportion of perforated surface area of the main section.

* * * * *